US008579077B2

(12) United States Patent
Ahn et al.

(10) Patent No.: US 8,579,077 B2
(45) Date of Patent: Nov. 12, 2013

(54) HORIZONTALLY INSTALLED MUFFLER HAVING SPORTY TONE

(75) Inventors: Hyeongyun Ahn, Hwaseong-si (KR); Hakson Han, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/488,254

(22) Filed: Jun. 4, 2012

(65) Prior Publication Data

US 2013/0213734 A1 Aug. 22, 2013

(30) Foreign Application Priority Data

Feb. 16, 2012 (KR) ..... 10-2012-0015787

(51) Int. Cl.

| | |
|---|---|
| ***F01N 1/00*** | (2006.01) |
| ***F01N 1/08*** | (2006.01) |
| ***F01N 1/24*** | (2006.01) |
| ***F01N 5/00*** | (2006.01) |
| ***F01N 13/00*** | (2010.01) |

(52) U.S. Cl.
USPC ..... 181/256; 181/212; 181/239; 181/254; 181/265; 181/268; 181/272

(58) Field of Classification Search
USPC ..... 181/256, 212, 239, 254, 265, 272
See application file for complete search history.

(56) References Cited

U.S. PATENT DOCUMENTS

| | | | | |
|---|---|---|---|---|
| 3,853,201 | A * | 12/1974 | Smale | 181/265 |
| 4,177,875 | A * | 12/1979 | Kurobe et al. | 181/265 |
| 4,589,517 | A * | 5/1986 | Fukuda | 181/265 |
| 5,025,890 | A * | 6/1991 | Hisashige et al. | 181/272 |
| 5,183,977 | A * | 2/1993 | Horitani | 181/266 |
| 5,559,308 | A * | 9/1996 | Hayashi | 181/265 |
| 5,783,782 | A * | 7/1998 | Sterrett et al. | 181/272 |
| 6,571,911 | B2 * | 6/2003 | Watanabe et al. | 181/265 |
| 7,562,741 | B2 * | 7/2009 | Winklel et al. | 181/239 |
| 7,712,578 | B2 * | 5/2010 | Han | 181/272 |
| 7,779,963 | B2 * | 8/2010 | Muto | 181/252 |

(Continued)

FOREIGN PATENT DOCUMENTS

| | | |
|---|---|---|
| JP | 2009-215941 A | 9/2009 |
| KR | 1999-021478 A | 3/1999 |

(Continued)

*Primary Examiner* — David Warren
*Assistant Examiner* — Christina Russell
(74) *Attorney, Agent, or Firm* — Morgan, Lewis & Bockius LLP

(57) ABSTRACT

A horizontally installed muffler may include a housing, first and second tail pipes installed to front and rear ends of the housing through the housing, an introduction chamber formed inside the housing and to which an outlet of the exhaust pipe is connected, a first intermediate pipe fluid-connected to the introduction chamber and having a first discharge hole, a discharge chamber fluid-connected to the introduction chamber through the first discharge hole of the first intermediate pipe, wherein each end of the first and second tail pipes and the first discharge hole are disposed inside the discharge chamber, first and second resonance chambers formed inside the housing, a second intermediate pipe fluid-connected to the first and second resonance chambers through the discharge chamber and the introduction chamber and having an introduction hole disposed inside the introduction chamber and a second discharge hole disposed inside the discharge chamber.

19 Claims, 9 Drawing Sheets

(56) References Cited

U.S. PATENT DOCUMENTS

| | | | | |
|---|---|---|---|---|
| 7,918,311 | B2 * | 4/2011 | Matsueda et al. | 181/275 |
| 7,934,583 | B2 * | 5/2011 | Reuther et al. | 181/282 |
| 8,196,702 | B2 * | 6/2012 | Park et al. | 181/239 |
| 8,205,713 | B2 * | 6/2012 | Gorke et al. | 181/212 |
| 8,205,716 | B2 * | 6/2012 | Wirth | 181/269 |
| 2008/0196969 | A1 * | 8/2008 | Henke et al. | 181/212 |
| 2009/0145689 | A1 * | 6/2009 | Han | 181/272 |
| 2009/0229913 | A1 * | 9/2009 | Tonietto et al. | 181/254 |
| 2010/0140014 | A1 * | 6/2010 | Han | 181/254 |
| 2011/0127105 | A1 * | 6/2011 | Lim et al. | 181/212 |
| 2011/0192676 | A1 * | 8/2011 | Wirth | 181/227 |

FOREIGN PATENT DOCUMENTS

| | | | |
|---|---|---|---|
| KR | 10-0868206 | B1 | 11/2008 |
| KR | 10-0962791 | B1 | 6/2010 |
| KR | 10-0993710 | B1 | 11/2010 |
| KR | 10-2011-0023466 | A | 3/2011 |
| KR | 10-2011-0038509 | A | 4/2011 |

* cited by examiner

HORIZONTALLY INSTALLED MUFFLER HAVING SPORTY TONE

CROSS-REFERENCE(S) TO RELATED APPLICATIONS

The present application claims priority to Korean Patent Application No. 10-2012-0015787, filed on Feb. 16, 2012, the entire contents of which is incorporated herein for all purposes by this reference.

BACKGROUND OF THE INVENTION

1. Field of the Invention

Exemplary embodiments of the present invention relate to a muffler of a vehicle, through which exhaust gas is finally discharged from the vehicle; and, particularly, to a horizontally installed muffler having a sporty tone, which divides a path of exhaust gas flowing inside the muffler according to the operating speed of an engine, thereby generating a sporty exhaust sound.

2. Description of Related Art

A vehicle includes a muffler for reducing an exhaust sound, which is generated according to the combustion of an engine, to the limit value or less. The muffler is connected to the engine and an exhaust pipe, and reduces noise of exhaust gas which is discharged from the engine after the combustion, while the exhaust gas passes through the muffler.

Meanwhile, most vehicles include a muffler which is manufactured in such a manner as to reduce operation noise as much as possible. However, vehicles such as coupes or sports cars, which are manufactured focusing on running performance, generates an exhaust sound having a unique sporty tone according to a running state such that a driver can feel the running performance through a sense of hearing, which is one of important market qualities.

For example, FIGS. 1 and 2 illustrate a conventional muffler which is disposed in the widthwise direction of a vehicle and includes tail pipes 150 of which the outlets are exposed to both sides of the muffler.

Referring to FIG. 1, the conventional muffler is connected to the rear end of an exhaust pipe 110, the front and rear ends of the muffler are disposed in a direction perpendicular to the longitudinal direction F of the vehicle, i.e., the widthwise direction of the vehicle, and the end of the exhaust pipe 110 is bent and connected to the front end of the muffler so as to introduce exhaust gas to the muffler.

FIG. 2 illustrates the internal structure of the conventional muffler. The conventional muffler includes a housing 120, a plurality of baffles 121 dividing the inside of the housing 120 into a plurality of chambers, an introduction pipe 141 connected to the exhaust pipe 110 and passing through the plurality of baffles 121, a pair of tail pipes 150 passing through the plurality of baffles 121 and discharging exhaust gas to the outside through both ends of the housing 120, and an intermediate pipe 142 disposed in parallel to the introduction pipe 141 and the tail pipes 150.

The above-described conventional muffler has a structure in which exhaust introduced to the muffler is passed only through one path to the tail pipes 150. Therefore, the conventional muffler cannot form a sporty exhaust sound.

Furthermore, since the end of the exhaust pipe 110 is bent to introduce exhaust gas into a side surface in the longitudinal direction F of the vehicle, back pressure may be increased to reduce the output of the vehicle.

Meanwhile, coupes or sports cars having a large engine displacement include a sound generator installed in a suction system, in order to generate a more sporty exhaust sound.

However, vehicles having a small engine displacement are difficult to be installed a separate sound generator due to layout. Thus, an exhaust system thereof absolutely contributes to generating a sporty exhaust sound. However, since vehicles having a small engine displacement have a relatively small number of cylinders, a combustion interval between the respective cylinders is longer than that of vehicles having a large engine displacement. Therefore, the pulsations of exhaust sounds are large, simple and not harmonic, which makes it difficult to generate sporty exhaust sounds.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a horizontally installed muffler having a sporty tone, which is capable of outputting a sporty exhaust sound such that a driver feel running performance through a sense of hearing, while reducing the volume of the entire exhaust sound, without a sound generator applied to an engine having a large displacement, a horizontally installed muffler which passes exhaust gas through different paths depending on the operation speed of an engine such that a sporty exhaust sound is generated from each operation region, and a horizontally installed muffler which is capable of increasing an output by reducing resistance of exhaust gas introduced to the muffler.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a horizontal installed muffler having a sporty tone is constructed in such a manner that exhaust gas discharged from an engine is transferred to the muffler through an exhaust pipe, front and rear ends of the muffler are disposed in a direction perpendicular to a longitudinal direction F of a vehicle, i.e., a widthwise direction of the vehicle, an end of the exhaust pipe is bent and connected to a side surface of the muffler which is formed to face the front direction of the vehicle in order to introduce the exhaust gas to the muffler, and the exhaust gas is discharged to the outside through a pair of tail pipes connected to the front and rear ends of the muffler which are formed to face the widthwise direction of the vehicle.

In the horizontally installed muffler having a sporty tone, the exhaust pipe is connected to an introduction chamber disposed in the housing, the outlet of the exhaust pipe is extended and connected to the inside of the introduction chamber, a discharge chamber is disposed to communicate with the introduction chamber, and the pair of tail pipes to discharge exhaust gas to the outside of the housing may have inlets positioned inside the discharge chamber. When the engine is operated at low speed, exhaust gas introduced to the introduction chamber is emitted to the discharge chamber through a first intermediate pipe having an inlet disposed adjacent to the outlet of the exhaust pipe and then discharged to the outside through the tail pipes. When the engine is operated at high speed, exhaust gas introduced to the introduction chamber is emitted to the discharge chamber through a second intermediate pipe having introduction holes formed more remotely from the outlet of the exhaust pipe than the first intermediate pipe, and then discharged to the outside through the tail pipes.

A virtual line extended from the exhaust pipe connected to the introduction chamber may be positioned above the tail pipes.

The exhaust pipe may be upward inclined and connected to the introduction chamber.

The exhaust pipe may be upward inclined at an angle of 26 degrees with respect to a horizontal plane and connected to the introduction chamber.

Inside the housing, the first intermediate pipe, the second intermediate pipe, and the tail pipes may be disposed in a direction perpendicular to the exhaust pipe.

The first intermediate pipe may be formed to may have a larger diameter than the second intermediate pipe.

Resonance chambers may be disposed at internal edges of the front and rear ends of the housing, respectively, both ends of the second intermediate pipe may be positioned in the resonance chambers, and the second intermediate pipe may connect the resonance chambers.

Inside housing, the discharge chamber may be positioned in the center of the housing, the introduction chamber may be disposed between the discharge chamber and any one of the resonance chambers, and a sound absorption chamber for reducing high-frequency flow noise may be disposed between the discharge chamber and the other resonance chamber.

Any one of the tail pipes may communicate with the sound absorption chamber.

The tail pipe passing through the sound absorption chamber may have a plurality of communication holes formed on the circumference of the tail pipe positioned in the absorption chamber.

A distance between an inlet and an outlet of the tail pipe passing through the introduction chamber and the resonance chamber from the discharge chamber may be set larger than a distance between communication holes and an outlet of the tail pipe passing through the sound absorption chamber and the resonance chamber from the discharge chamber.

The inside of the sound absorption chamber may be filled with glass wool.

The first intermediate pipe connecting the introduction chamber and the discharge chamber may be formed to have a larger length than the second intermediate pipe having both ends positioned in the resonance chambers, respectively.

The first intermediate pipe may have an inlet positioned adjacent to the outlet of the exhaust pipe inside the introduction chamber and an outlet including a plurality of discharge holes formed along the circumference of the first intermediate pipe and positioned in the discharge chamber.

The second intermediate pipe may have an inlet including a plurality of introduction holes formed along the circumference thereof and positioned on the extended line of the exhaust pipe from the outlet of the exhaust pipe inside the introduction chamber and an outlet including a plurality of second discharge holes formed along the circumference thereof and positioned inside the discharge chamber.

The sum of areas of the introduction holes in the second intermediate pipe may be larger than the sum of areas of the second discharge holes.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
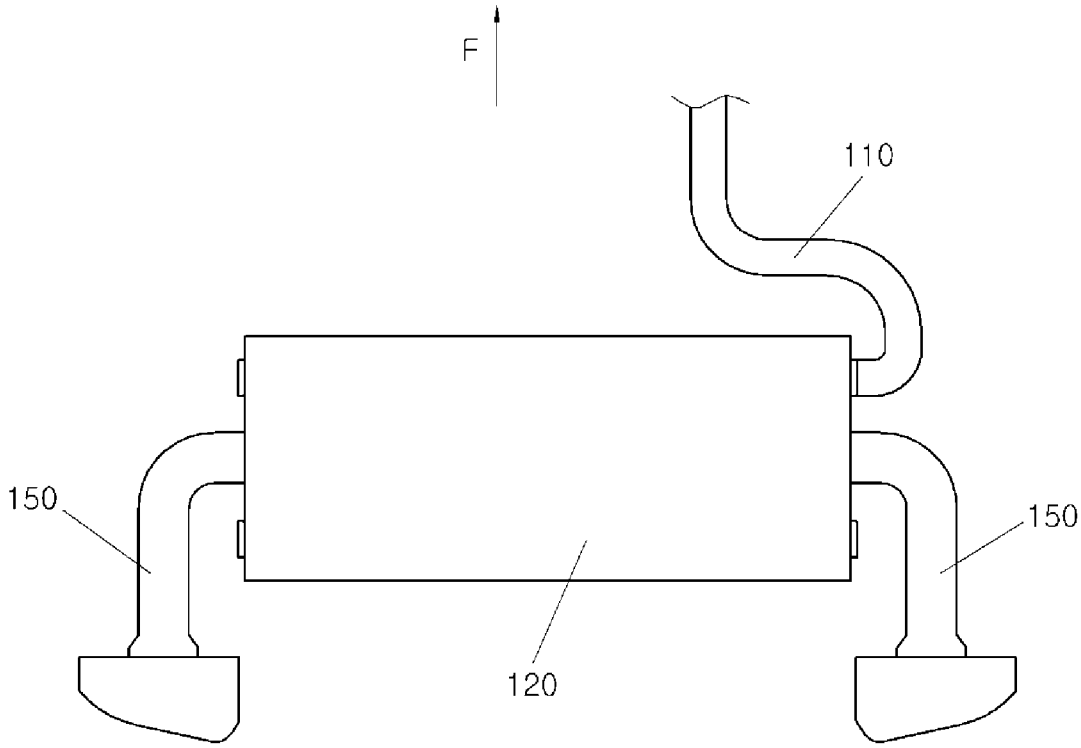
FIG.1 (Prior Art)
FIG. 1 is a plan view illustrating a state in which a conventional muffler is connected to an exhaust pipe.
Figure 2:
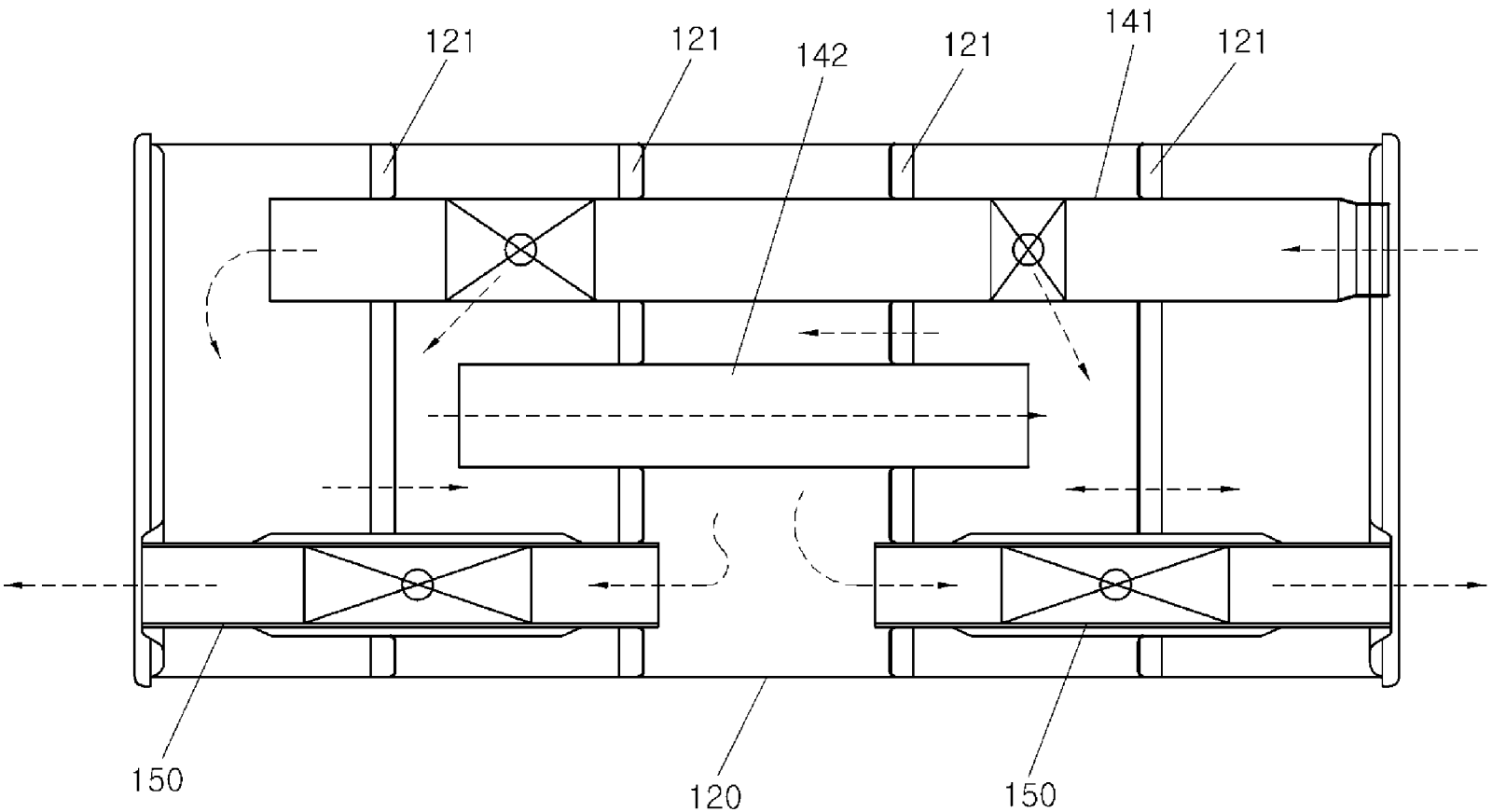
FIG.2 (Prior Art)
FIG. 2 is a plan view illustrating the internal structure of the conventional muffler.
Figure 3:
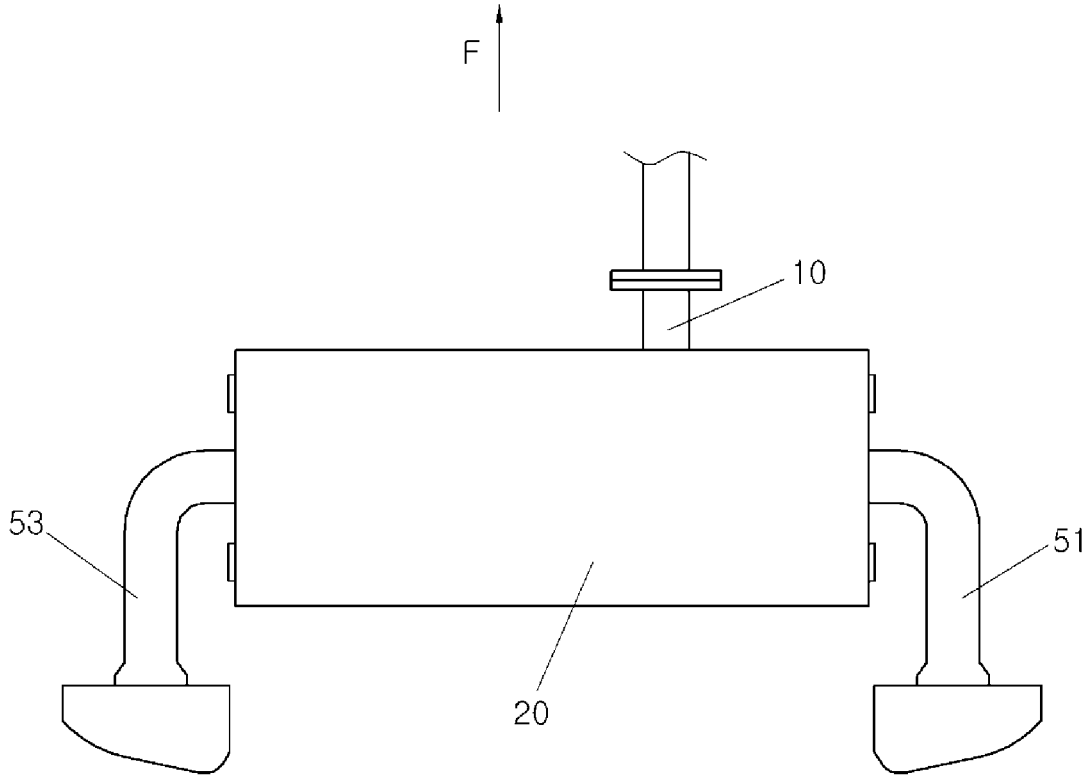
FIG. 3 is a plan view illustrating a state in which a horizontally installed muffler having a sporty tone in accordance with an embodiment of the present invention is connected to an exhaust pipe.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DESCRIPTION OF SPECIFIC EMBODIMENTS

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A horizontally installed muffler having a sporty tone in accordance with an exemplary embodiment of the present invention is constructed in such a manner that an exhaust pipe 10 is connected to an introduction chamber 32 disposed inside a housing 20, an outlet of the exhaust pipe 10 is extended and connected to the inside of the introduction chamber 32, a discharge chamber 33 is disposed to communicate with the introduction chamber 32, a pair of tail pipes 51 and 53 for discharging exhaust gas to the outside of the housing 20 have inlets positioned inside the discharge chamber 33, when the engine is operated at low speed, exhaust gas introduced to the introduction chamber 32 is emitted to the discharge chamber 33 through a first intermediate pipe 41 having an inlet disposed adjacent to the outlet of the exhaust pipe 10 and then discharged to the outside through the tail pipes 51 and 53, and when the engine is operated at high speed exhaust gas introduced to the introduction chamber 32 is emitted to the discharge chamber 33 through a second intermediate pipe 43 having introduction holes formed more remotely from the outlet of the exhaust pipe 10 than the first intermediate pipe 41 and then discharged to the outside through the tail pipes 51 and 53.

The horizontally installed muffler in accordance with the exemplary embodiment of the present invention may be defined as a muffler having a structure in which the housing 20 of the muffler has a cylindrical shape to extend in the widthwise direction of the vehicle and the front and rear ends of the muffler are disposed to face the widthwise direction of the vehicle. In such a horizontally installed muffler, the exhaust pipe to which exhaust gas discharged from the engine is introduced is connected to a side surface of the housing 20 formed toward the front direction of the vehicle, the front and rear ends of the housing 20 are disposed to face the widthwise direction of the vehicle, and exhaust gas is discharged to the outside by the tail pipes connected to the front and rear ends of the housing 20, respectively.

The inside of the housing 20 is divided into a plurality of chambers by a plurality of baffles 21. Desirably, four baffles 21 may be arranged at predetermined distances from each other inside the housing 20, in order to dive the inside of the housing 20 into five chambers. The five chambers formed inside the housing 20 are set to independent spaces by the respective baffles 21.

Here, the five chambers formed inside the housing 20 include a discharge chamber 33 positioned in the center thereof, resonance chambers 31 and 35 disposed at both edges of the housing 20, and an introduction chamber 32 and a sound absorption chamber 34 disposed between the discharge chamber 33 and the resonance chambers 31 and 35, respectively.

Figure 4:
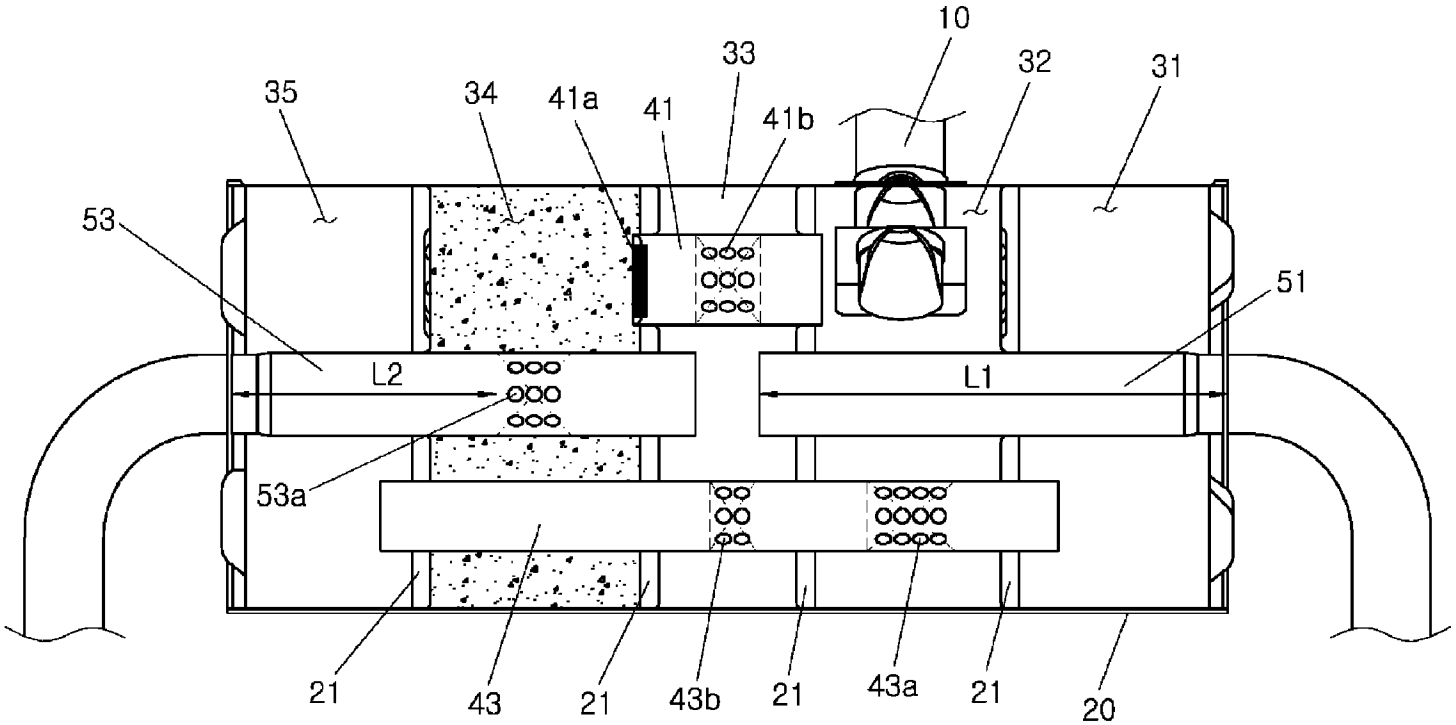
FIG. 4 is a plan view illustrating the internal structure of the horizontally installed muffler having a sporty tone in accordance with the embodiment of the present invention.

For example, referring to FIG. 4, the resonance chamber 31, the introduction chamber 32, the discharge chamber 33, the sound absorption chamber 34, and the resonance chamber 35 may be sequentially arranged from the right side of FIG. 4.

A main flow path of exhaust gas is decided according to the operation speed of the engine. More specifically, when the engine is operated at a low speed of less than about 2,000 rpm, the exhaust gas introduced to the housing 20 is introduced to the introduction chamber 32 and then discharged to the outside through the discharge chamber 33 and the sound absorption chamber 34, and when the engine is operated at a high speed of 2,000 rpm or more, the exhaust gas is introduced into the introduction chamber 32, resonates in the resonance chambers 31 and 35, and is then discharged to the outside through the discharge chamber 33 and the sound absorption chamber 34.

The introduction chamber 32 is connected to the exhaust pipe 10. The muffler in accordance with the exemplary embodiment of the present invention is a horizontally installed muffler formed in the widthwise direction of the vehicle, and the chambers are arranged in the widthwise direction of the housing 20. Therefore, the exhaust pipe 10 is directly connected to the introduction chamber 32 through the housing 20 in a direction perpendicular to the housing 20.

Furthermore, the exhaust pipe 10 has an end positioned inside the introduction chamber 32. The exhaust pipe 10 is formed through the housing 20 so as to extend to the inside of the introduction chamber 32, and the outlet of the exhaust pipe 10 is positioned inside the introduction chamber 32.

Since the exhaust pipe 10 is formed through the housing 20, a flow of exhaust gas is not bent but directly introduced to the introduction chamber 32. Accordingly, the exhaust pipe 10 reduces back pressure to thereby contribute to increasing the output of the engine.

Furthermore, as the diameter of the exhaust pipe 10 is set larger than in the conventional muffler, it is possible to contribute to increasing the output of the engine.

As the exhaust pipe 10 has an increased diameter and is directly connected to the introduction chamber 32 to increase the output, the entire size of the housing 20, that is, the entire capacity of the muffler is set larger than in the conventional muffler, in order to reduce exhaust noise.

While the engine is operated at high speed, the exhaust pipe 10 inside the introduction chamber 32 should send exhaust gas to the second intermediate pipe 43 which will be described below. Since the outlet of the exhaust pipe 10 and the second intermediate pipe 43 are separated from each other, a virtual line extended from the end of the exhaust pipe 10 is positioned above the tail pipes 51 and 53 positioned in the middle of the cross-section of the housing 20 such that exhaust gas emitted from the exhaust pipe 10 is introduced to the second intermediate pipe 43 over the tail pipes 51 and 53.

Figure 5:
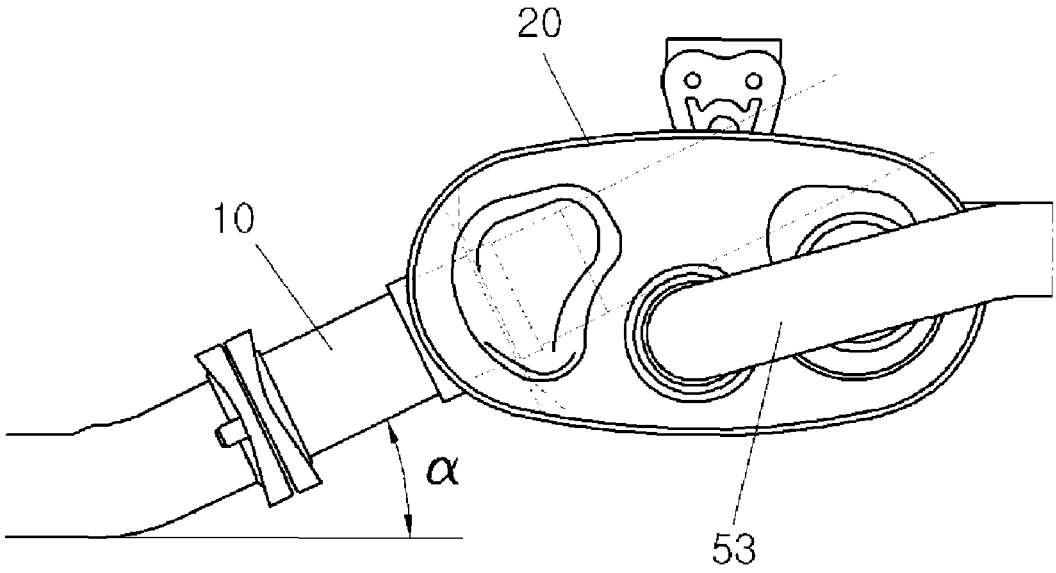
FIG. 5 is side view illustrating the arrangement relation between the exhaust pipe and tail pipes in the horizontally installed muffler having a sporty tone in accordance with the embodiment of the present invention.

For this operation, the outlet of the exhaust pipe 10 is upward inclined and connected to the introduction chamber 32 as illustrated in FIG. 5. For example, the exhaust pipe 10 may be upward inclined at an angle $\alpha$ of 26 degrees with respect to the ground.

The discharge chamber 33 is disposed to communicate with the introduction chamber 32 such that the exhaust gas introduced to the introduction chamber 32 is emitted to the discharge chamber 33 and then discharged to the outside. Inside the discharge chamber 33, the inlets of the tail pipes 51 and 53 are positioned to discharge the exhaust gas emitted to the discharge chamber 33 to the outside through the tail pipes 51 and 53.

The resonance chambers 31 and 35 are formed at both edges of the housing 20, respectively. When the engine is mostly operated at 2,000 rpm or more, the exhaust gas resonates in the resonance chambers 31 and 35, thereby improving the tone of an exhaust sound.

Furthermore, the introduction chamber 32 is disposed adjacent to the discharge chamber 33 disposed in the middle of the housing 20, and the sound absorption chamber 34 is disposed in the opposite side of the introduction chamber 32 from the discharge chamber 33.

The sound absorption chamber 34 receives part of the exhaust gas emitted to the discharge chamber 32 from the introduction chamber 33, thereby reducing high-frequency flow noise.

The inside of the sound absorption chamber 34 is filled with glass wool serving as a sound absorption member, in order to effectively absorb sounds.

As described above, the five chambers divided by the baffles 21 inside the housing 20 are arranged in order of the resonance chamber 31, the introduction chamber 32, the discharge chamber 33, the sound absorption chamber 34, and the resonance chamber 35, and connected to each other through the pipes which may pass exhaust gas, thereby forming flow paths of the exhaust gas.

The introduction chamber 32 and the discharge chamber 33, which communicate with each other, have two exhaust gas flow paths passing through the first or second intermediate pipe 41 or 43 which will be described below, depending on the operation speed of the engine.

That is, when the engine is operated at a low speed of less than about 2,000, most exhaust gas is moved to the discharge chamber 33 from the introduction chamber 32 through the first intermediate pipe 41, and when the engine is operated at a high speed of 2,000 or more, most exhaust gas is passed through the second intermediate pipe 43.

Meanwhile, the exhaust gas emitted to the discharge chamber 33 is discharged to the outside of the housing 20 through the pair of tail pipes 51 and 53 of which the inlets are formed to be positioned in the discharge chamber 33.

Since the first intermediate pipe 41, the second intermediate pipe 43, and the tail pipes 51 and 53 are arranged in the widthwise direction of the vehicle so as to pass through the respective chambers inside the housing 20, the first intermediate pipe 41, the second intermediate pipe 43, and the tail pipes 51 and 53 are arranged perpendicular to the exhaust pipe 10.

When the engine is operated at low speed, the first intermediate pipe 41 serves as a flow path of exhaust gas through the introduction chamber 32 and the discharge chamber 33. For this structure, the first intermediate pipe 41 is disposed perpendicular to the exhaust pipe 10, and the inlet of the first intermediate pipe 41 is positioned inside the introduction chamber 32, and positioned adjacent to the outlet of the exhaust pipe 10. The outlet of the first intermediate pipe 41 includes a plurality of first discharge holes 41*b* formed with a small diameter on the circumference of thereof. The first discharge holes 41*b* are arranged along the circumference of the first intermediate pipe 41 at a portion of the first intermediate pipe 41, which is positioned in the discharge chamber 33. At this time, the first discharge holes 41*b* may be arranged at a predetermined width along the circumference of the exhaust pipe 10.

While the exhaust gas introduced to the first intermediate pipe 41 having a relatively large diameter is discharged to the first discharge holes 41*b* having a small diameter, the volume of the exhaust sound is reduced, and the tone of the exhaust sound is improved.

Meanwhile, reference numeral 41*a* represents a cap which blocks the end of the first intermediate pipe 41 such that the exhaust gas introduced to the first intermediate pipe 41 is discharged through the first discharge holes 41*b*.

The second intermediate pipe 43 includes a plurality of introduction holes 43*a* formed at a portion of the second intermediate pipe 43, which is positioned in the introduction chamber 32, and a plurality of second discharge holes 43*b* formed at a portion of the second intermediate pipe 43, which is positioned in the discharge chamber 33. The introduction holes 43*a* serve as the inlet of the second intermediate pipe 43, and the second discharge holes 43*b* serve as the outlet of the second intermediate pipe 43. The introduction holes 43*a* and the second discharge holes 43*b* are formed with a small diameter on the circumference of the second intermediate pipe 43 and arranged at a predetermined width, like the first discharge holes 41*b*. In particular, as the introduction holes 43*a* are formed separately from the outlet of the exhaust pipe 10 along the virtual line extended from the exhaust pipe 10 inside the introduction chamber 32, the exhaust gas may be easily introduced into the second intermediate pipe 43 through the introduction holes 43*a* when the engine is operated at high speed. Since the virtual line extended from the exhaust pipe 10 connected to the introduction chamber 32 is positioned above the tail pipes 51 and 53, the exhaust gas from the exhaust pipe 10 may be passed along the internal surface of the housing 20 over the top of the tail pipes 51 and 53 and then transferred to the second intermediate pipe 43 positioned behind the tail pipes 51 and 53 from the exhaust pipe 10, when the engine is operated at high speed.

Meanwhile, the sum of areas of the introduction holes 43*a* in the second intermediate pipe 43 may be set larger than that of the second discharge holes 43*b*. During high-speed operation, while the exhaust gas introduced to the introduction holes 43*a* is discharged to the discharge chamber 33 through the second discharge holes 43*b*, part of the exhaust gas is introduced to the resonance chambers 31 and 35 communicating with both ends of the second intermediate pipe 43 and then resonate to improve the tone of an exhaust sound.

The second intermediate pipe 43 is disposed perpendicular to the exhaust pipe 10 inside the housing 20 such that the resonance chambers 31 and 35 disposed at both edges of the housing 20 communicate with each other and both ends of the second intermediate pipe 43 are positioned in the resonance chambers 31 and 35, respectively.

Furthermore, the diameter of the second intermediate pipe 43 is set smaller than the diameter of the first intermediate pipe 41. Accordingly, during low-speed operation, the exhaust gas emitted at low speed into the introduction chamber 32 from the exhaust pipe 10 may be easily introduced in the longitudinal direction of the first intermediate pipe 41 having a larger diameter than the second intermediate pipe 43.

Furthermore, when the engine is operated at high speed, the exhaust gas emitted at high speed into the introduction chamber 32 from the exhaust pipe 10 is continuously moved in the direction where the exhaust gas is emitted, and then introduced to the second intermediate pipe 43 through the introduction holes 43*a* of the second intermediate pipe 43 in such a manner as to pass through the side surface of the second intermediate pipe 43. Therefore, the entire area of the introduction holes 43*a* in the second intermediate pipe 43 is more important than the diameter thereof.

Furthermore, since both ends of the second intermediate pipe 43 are positioned in the resonance chambers 31 and 35 disposed at both edges of the housing 20, respectively, the second intermediate pipe 43 is formed longer than the first intermediate pipe 41 connecting only the introduction chamber 32 and the discharge chamber 33.

The inlets of the tail pipes 51 and 53 are positioned in the discharge chamber 33 and the outlets thereof are positioned outside the housing 20 such that the exhaust gas introduced to the housing 20 is discharged to the outside through the tail pipes 51 and 53. The pair of tail pipes 51 and 53 is disposed at both sides of the housing 20 from the discharge chamber 33. For example, the first tail pipe 51 may be disposed to pass through the introduction chamber 32 and the resonance chamber 31 from the discharge chamber 33, and the second tail pipe 53 may be disposed to pass through the sound absorption chamber 34 and the resonance chamber 35 from the discharge chamber 33. Between the tail pipes 51 and 53, the second tail pipe 53 is connected to the outside from the discharge chamber 33 while communicating with the sound absorption chamber 34, and the first tail pipe 51 is connected to the outside from the discharge chamber 33 without a direct communication with the introduction chamber 32 and the resonance chamber 31.

At this time, the second tail pipe 53 is formed to communicate with the sound absorption chamber 34. As a plurality of communication holes 53*a* are formed at a portion of the second tail pipe 53, which is positioned in the sound absorption chamber 34, the second tail pipe 53 and the sound absorption chamber 34 communicate with each other. The plurality of communication holes 53*a* are formed at a predetermined width along the circumference of the second tail pipe 53, like the first discharge holes 41*b*, the second discharge holes 43*b*, and the introduction holes 43*a*.

Meanwhile, since the second tail pipe 53 has the communication holes, the first tail pipe 51 and the second tail pipe 53 are asymmetrically constructed. That is, as the communication holes are formed in the second tail pipe 53, a distance L1 between the inlet and the outlet in the first tail pipe 51 is set larger than a distance L2 between the outlet and the communication holes 53 serving as the inlet in the second tail pipe 53 (Here, it is assumed that the lengths of the tail pipes exposed to the outside of the housing are equal to each other). In other words, when the distance L1 between the inlet of the first tail pipe 51 and the right outlet of the muffler is compared with the distance L2 between the communication holes 53*a* of the second tail pipe 53 and the left side of the muffler, a relation of L1>L2 is established.

Now, the operation of the horizontally installed muffler having a sporty tone in accordance with the exemplary embodiment of the present invention will be described as follows.

The horizontally installed muffler having a sporty tone in accordance with the exemplary embodiment of the present invention changes a main flow of exhaust gas according to the rotation speed (rpm) of the engine. For example, in a low-speed operation region where the rotation speed of the engine is lower than about 2,000 rpm, the exhaust gas is discharged to the outside through the first intermediate pipe 41 as illustrated in FIG. 6, and in a high-speed operation region where the rotation speed of the engine is higher than 2,000 rpm, the exhaust gas is discharged to the outside through the second intermediate pipe 42 as illustrated in FIG. 7.

Figure 6:
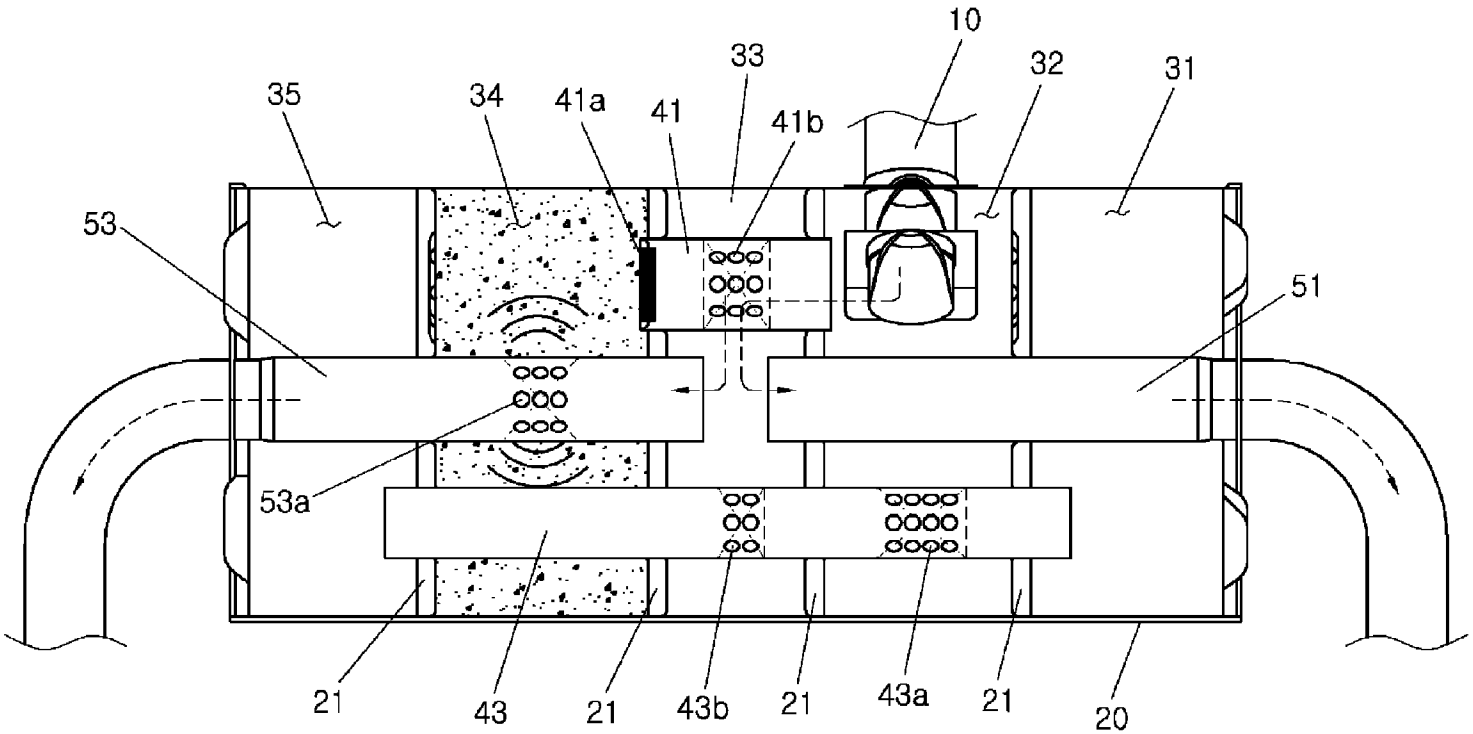
FIG. 6 is a plan view illustrating an exhaust gas flow in a low-speed operation region in the horizontally installed muffler having a sporty tone in accordance with the embodiment of the present invention.

In the low-speed operation region where the rotation speed of the engine does not exceed 2,000 rpm, when the exhaust gas is introduced to the introduction chamber 32 through the exhaust pipe 10 as indicated by dotted arrows in FIG. 6, most of the exhaust gas is emitted to the discharge chamber 33 through the first intermediate pipe 41 from the introduction chamber 32 and then discharged to the outside through the tail pies 51 and 53 from the discharge chamber 33. Since the outlet of the exhaust pipe 10 is disposed adjacent to the first intermediate pipe 41, most of the exhaust gas is emitted to the discharge chamber 33 through the first intermediate pipe 41 adjacent to the outlet of the exhaust pipe 10 when the engine is operated at low speed.

Figure 7:
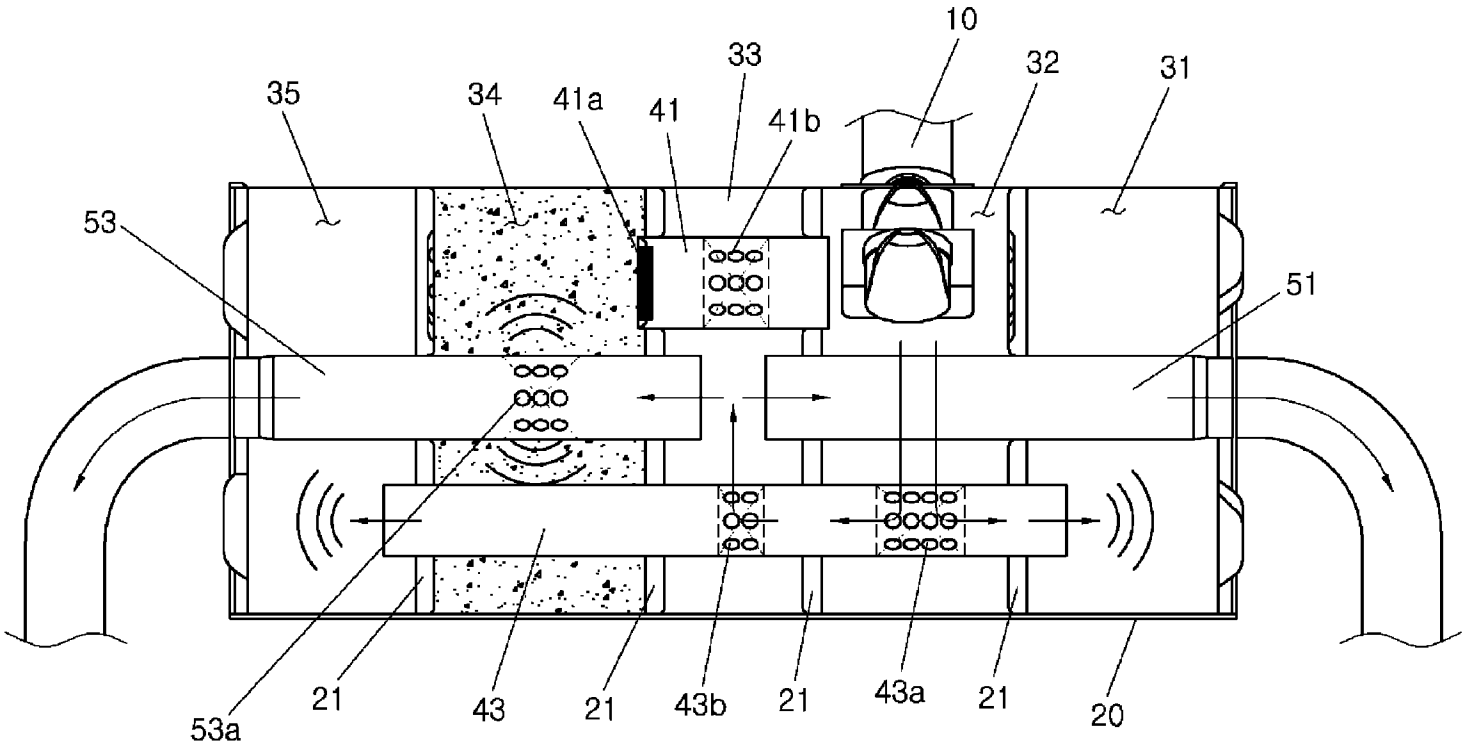
FIG. 7 is a plan view illustrating an exhaust gas flow in a high-speed operation region in the horizontally installed muffler having a sporty tone in accordance with the embodiment of the present invention.

Meanwhile, in the high-speed operation region where the rotation speed of the engine exceeds 2,000 rpm, most of the exhaust gas is moved to the discharge chamber 33 from the introduction chamber 32 through the second intermediate pipe 43 as indicated by solid arrows in FIG. 7. Since the engine is operated at high speed, the exhaust gas emitted to the introduction chamber 32 from the discharge pipe 10 sufficiently maintains the flow thereof even after the exhaust gas is emitted. Therefore, most of the exhaust gas is hardly introduced to the first intermediate pipe 41 which is disposed adjacent to the outlet of the exhaust pipe 10 but disposed perpendicular to the exhaust pipe 10, but introduced to the second intermediate pipe 43 having the introduction holes 43*a* formed in the flow direction of the exhaust gas even though the second intermediate pipe 43 is separated from the outlet of the exhaust pipe 10. In particular, since the exhaust pipe 10 is upward inclined and connected and the virtual line extended from the exhaust pipe 10 is positioned above the tail pipes 51 and 53, most of the exhaust gas emitted from the outlet of the exhaust pipe 10 during high-speed operation is smoothly introduced to the introduction holes 43*a* of the second intermediate pipe 43.

The exhaust pipe introduced to the introduction holes 43*a* of the second intermediate pipe 43 is emitted to the discharge chamber 33 through the second discharge holes 43*b*, and then discharged to the outside through the tail pipes 51 and 53.

Meanwhile, when the engine is operated at high speed, the exhaust gas introduced to the second intermediate pipe 43 is also moved to the resonance chambers 31 and 35 where both ends of the second intermediate pipe 43 are positioned, and then resonates in the resonance chambers 31 and 35, thereby improving the tone of the exhaust sound.

Furthermore, high-frequency flow noise of the exhaust gas discharged to the outside through the second tail pipe 53 is reduced by the sound absorption chamber 34, regardless of the operation speed of the engine.

In the horizontally-installed muffler having a sporty tone in accordance with the exemplary embodiment of the present invention, the number of main components of the exhaust sound is two times larger than the number of cylinders of the engine. Therefore, the main components of the exhaust sound appear even between combustion periods of the respective cylinders, thereby generating a sporty exhaust sound.

Figure 8:
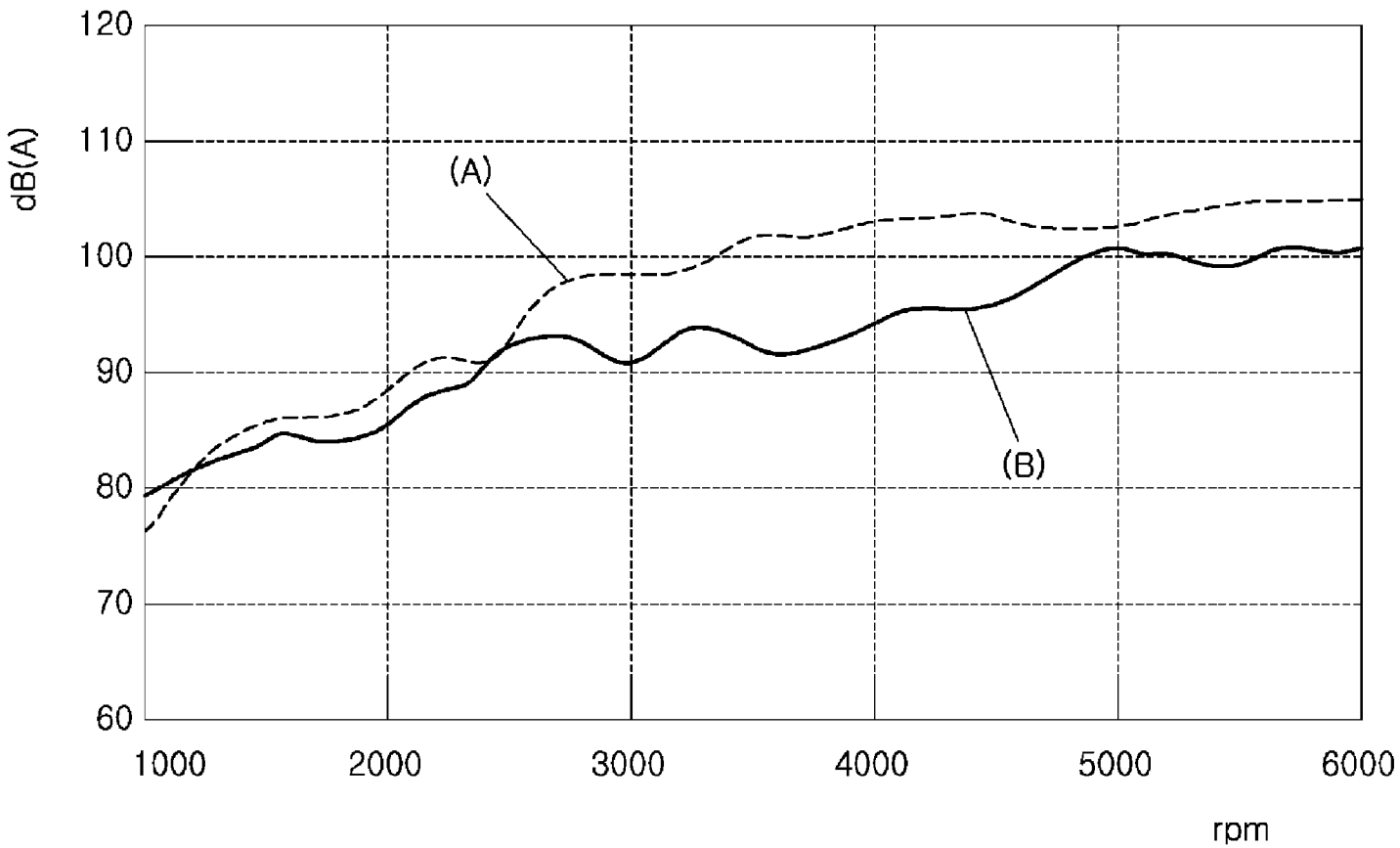
FIG. 8 is a graph comparatively showing the sound volumes of the entire exhaust sound measured in the horizontally-installed muffler having a sporty tone in accordance with the embodiment of the present invention and the conventional muffler.
Figure 9:
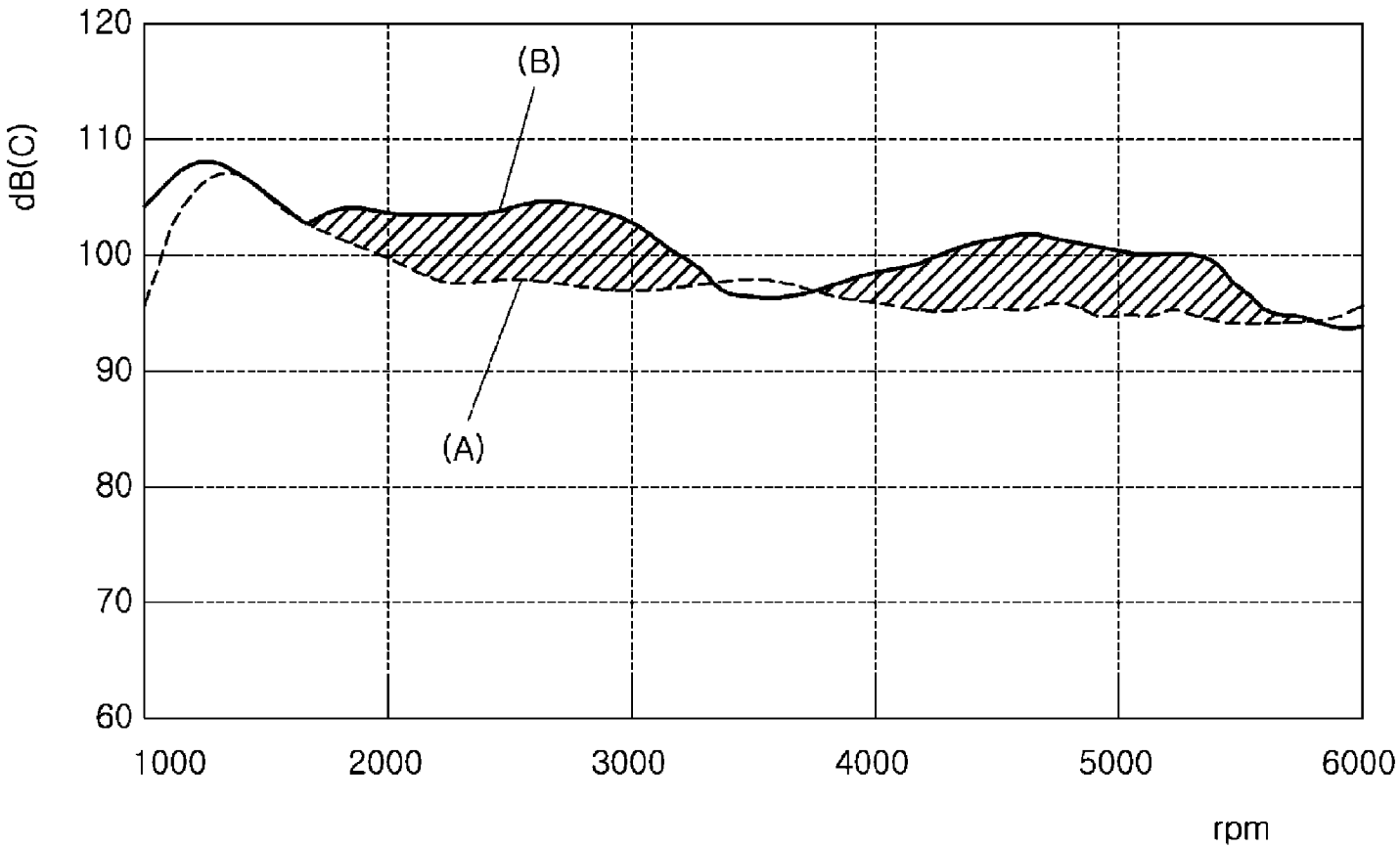
FIG. 9 is a graph comparatively showing the sound volumes of booming noises extracted from the exhaust sounds in the horizontally-installed muffler having a sporty tone in accordance with the embodiment of the present invention and the conventional muffler.

FIGS. 8 and 9 are graphs showing the sound volumes (dB(A)) of the entire exhaust sound and the sound volumes (dB(C)) of booming noise extracted from the exhaust sound in the horizontally-installed muffler having a sporty tone in accordance with the exemplary embodiment of the present invention and the conventional muffler.

Referring to FIG. 8, it can be seen that the sound volume of the entire exhaust sound of the muffler in accordance with the exemplary embodiment of the present invention as indicated by symbol (B) is reduced in comparison with the sound volume of the exhaust sound generated by the conventional muffler as indicated by symbol (A).

Referring to FIG. 9 showing a result obtained by applying a weight to booming noise to make a sporty exhaust sound from the entire exhaust sound, the booming noise component B in accordance with the exemplary embodiment of the present invention is positioned over the booming noise component A in accordance with the conventional muffler in a region where the vehicle is started (1,800~3,200 rpm) or a region where the vehicle is driven at as high speed as possible (4,000~5,500 rpm). Therefore, it can be seen that the exhaust sound of the engine is emphasized more sportily by areas indicated by slashes.

In accordance with the exemplary embodiments of the present invention, the horizontally installed muffler having a sporty tone may be mounted in coupes or sports cars and generate a sporty exhaust sound according to a running state such that a driver may feel running performance through a sense of hearing, which makes it possible to improve the market qualities of the vehicles.

In particular, since exhaust gas is passed through different paths inside the muffler depending on the operation speed of the engine, the volume of the entire exhaust sound may be reduced, and a sporty exhaust sound may be emphasized.

Meanwhile, since the outlet of the exhaust pipe is not bent but directly connected to the introduction camber in the longitudinal direction of the vehicle, a reduction in back pressure may be prevented to thereby contribute to increasing the output of the engine.

While the present invention has been described with respect to the specific embodiments, it will be apparent to those skilled in the art that various changes and modifications may be made without departing from the spirit and scope of the invention as defined in the following claims.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A horizontally installed muffler having a sporty tone, which receives exhaust gas emitted from an engine through an exhaust pipe at a side surface of a housing formed in a widthwise direction of a vehicle and emits the exhaust gas to the outside through a pair of tail pipes connected to front and rear ends of the housing formed in the widthwise direction of the vehicle, wherein the side surface of the housing is formed to face a front of the vehicle and connected to the exhaust pipe, the exhaust pipe is connected to an introduction chamber disposed inside the housing and has an outlet extended and connected to the inside of the introduction chamber, a discharge chamber is disposed to fluid-communicate with the introduction chamber, the pair of tail pipes to discharge the exhaust gas to the outside of the housing has inlets positioned inside the discharge chamber, when the engine is operated at a speed lower than a predetermined value, the exhaust gas introduced to the introduction chamber is emitted to the discharge chamber through a first intermediate pipe having an inlet disposed adjacent to the outlet of the exhaust pipe and then discharged to the outside through the tail pipes, and when the engine is operated at a speed higher than the predetermined value, the exhaust gas introduced to the introduction chamber is emitted to the discharge chamber through a second intermediate pipe having introduction holes formed more remotely from the outlet of the exhaust pipe than the first intermediate pipe, and then discharged to the outside through the tail pipes.

2. The horizontally installed muffler of claim 1, wherein a virtual line extended from the exhaust pipe connected to the introduction chamber is positioned above the tail pipes such that, when the engine is operated at the speed higher than the predetermined value, the exhaust gas from the exhaust pipe is passed along an inter surface of the housing over the top of the tail pipes, and then transferred to the second intermediate pipe positioned behind the tail pipes from the exhaust pipe.

3. The horizontally installed muffler of claim 2, wherein the second intermediate pipe has an inlet comprising a plurality of introduction holes formed along the circumference thereof and positioned on the extended line of the exhaust pipe from the outlet of the exhaust pipe inside the introduction chamber and an outlet comprising a plurality of second discharge holes formed along the circumference thereof and positioned inside the discharge chamber.

4. The horizontally installed muffler of claim 1, wherein the exhaust pipe is inclined at a predetermined angle with respect to the horizontal level and connected to the introduction chamber.

5. The horizontally installed muffler of claim 4, wherein the exhaust pipe is upward inclined at the predetermined angle of 26 degrees and connected to the introduction chamber.

6. The horizontally installed muffler of claim 1, wherein the first intermediate pipe, the second intermediate pipe, and the tail pipes inside the housing are disposed in a direction perpendicular to the exhaust pipe.

7. The horizontally installed muffler of claim 1, wherein the diameter of the first intermediate pipe is larger than that of the second intermediate pipe.

8. The horizontally installed muffler of claim 1, wherein resonance chambers are disposed at internal edges of the front and rear ends of the housing, respectively, and the second intermediate pipe connects the resonance chambers.

9. The horizontally installed muffler of claim 8, wherein the length of the second intermediate pipe having both ends positioned in the respective resonance chambers is larger than the length of the first intermediate pipe connecting the introduction chamber and the discharge chamber.

10. The horizontally installed muffler of claim 8, wherein, inside the housing, the discharge chamber is positioned in the center of the housing, the introduction chamber is disposed between the discharge chamber and any one of the resonance chambers, and a sound absorption chamber for reducing high-frequency flow noise is disposed between the discharge chamber and the other resonance chamber.

11. The horizontally installed muffler of claim 10, wherein the inside of the sound absorption chamber is filled with glass wool.

12. The horizontally installed muffler of claim 10, wherein a second tail pipe of the tail pipes is connected to the outside from the discharge chamber while communicating with the sound absorption chamber, and a first tail pipe is connected to the outside without a direct communication with the introduction chamber and the resonance chamber.

13. The horizontally installed muffler of claim 12, wherein the second tail pipe passing through the sound absorption chamber has a plurality of communication holes formed on the circumference of the second tail pipe positioned in the sound absorption chamber.

14. The horizontally installed muffler of claim 13, wherein when a distance L1 between an inlet of the first tail pipe and a right outlet of the muffler is compared to a distance L2 between the communication holes of the second tail pipe and a left outlet of the muffler, a relation of L1>L2 is established.

15. The horizontally installed muffler of claim 1, wherein the first intermediate pipe has an inlet positioned adjacent to the outlet of the exhaust pipe inside the introduction chamber and an outlet comprising a plurality of discharge holes formed along the circumference of the first intermediate pipe and positioned in the discharge chamber.

16. The horizontally installed muffler of claim 1, wherein the sum of areas of the introduction holes in the second intermediate pipe is larger than the sum of areas of the second discharge holes.

17. A horizontally installed muffler, comprising:

a housing;

first and second tail pipes installed to front and rear ends of the housing through the housing;

an introduction chamber formed inside the housing and to which an outlet of an exhaust pipe is connected;

a first intermediate pipe fluid-connected to the introduction chamber and having a first discharge hole;

a discharge chamber fluid-connected to the introduction chamber through the first discharge hole of the first intermediate pipe, wherein each end of the first and second tail pipes and the first discharge hole of the first intermediate pipe are disposed inside the discharge chamber;

first and second resonance chambers formed inside the housing;

a second intermediate pipe fluid-connected to the first and second resonance chambers through the discharge chamber and the introduction chamber and having an introduction hole disposed inside the introduction chamber and a second discharge hole disposed inside the discharge chamber;

wherein, in accordance with pressure of an exhaust gas, the exhaust gas introduced to the introduction chamber is emitted to the discharge chamber through the first discharge hole of the first intermediate pipe and then discharged to the outside through the first and second tail pipes or emitted to the discharge chamber through the introduction hole and the second discharge hole of the second intermediate pipe and then discharged to the outside through the first and second tail pipes.

18. The horizontally installed muffler of claim 17, wherein a distance between an inlet of the first intermediate pipe and the outlet of the exhaust pipe is shorter than a distance between the introduction hole of the second intermediate pipe and the outlet of the exhaust pipe.

19. The horizontally installed muffler of claim 17, further comprising a sound absorption chamber between the second resonance chamber and the discharge chamber, wherein the second tail pipe includes a communication hole formed on an outer surface thereof and disposed in the sound absorption chamber to fluid-communicate the sound absorption chamber with the discharge chamber, and wherein the inside of the sound absorption chamber is filled with glass wool.

* * * * *